US005687936A

United States Patent [19]

Wilson

[11] Patent Number: 5,687,936

[45] Date of Patent: Nov. 18, 1997

[54] GUTTER BRACKET

[76] Inventor: Dennis E. Wilson, 240 Desha Rd., Lexington, Ky. 40502

[21] Appl. No.: 483,751

[22] Filed: Jun. 7, 1995

[51] Int. Cl.[6] ..... E04D 13/06

[52] U.S. Cl. ..... 248/48.2; 52/11; 52/714

[58] Field of Search ..... 248/48.2, 48.1, 248/229.16, 229.26, 231.81; 52/11, 712, 714

[56] References Cited

U.S. PATENT DOCUMENTS

| | | | |
|---|---|---|---|
| Re. 22,992 | 3/1948 | Rachlin . | |
| 78,617 | 6/1868 | Stine . | |
| 302,358 | 7/1884 | Rock . | |
| 435,173 | 8/1890 | Forbes | 248/48.1 X |
| 658,502 | 9/1900 | Laird . | |
| 664,637 | 12/1900 | Heib . | |
| 707,941 | 8/1902 | Pope . | |
| 813,826 | 2/1906 | Rau | 248/48.1 |
| 869,195 | 10/1907 | Patchin . | |
| 1,478,837 | 12/1923 | Rachlin . | |
| 1,593,139 | 7/1926 | Rachlin . | |
| 1,630,935 | 5/1927 | Geiser . | |
| 1,632,036 | 6/1927 | Mullen . | |
| 1,781,085 | 11/1930 | Skinner . | |
| 2,132,587 | 10/1938 | Steckler . | |
| 2,365,971 | 12/1944 | Rachlin . | |
| 3,874,131 | 4/1975 | Webster | 248/48.2 X |
| 4,258,510 | 3/1981 | Guiana | 52/16 X |
| 4,608,786 | 9/1986 | Beam | 52/16 |
| 4,631,875 | 12/1986 | Olson | 248/48.2 X |
| 5,303,521 | 4/1994 | Jansen | 52/11 X |
| 5,327,689 | 7/1994 | Jansen | 248/48.2 X |
| 5,437,138 | 8/1995 | Tuohey et al. | 52/11 X |
| 5,456,441 | 10/1995 | Calliens | 52/714 X |

*Primary Examiner*—Ramon O. Ramirez
*Attorney, Agent, or Firm*—Frost & Jacobs

[57] ABSTRACT

A single piece gutter bracket having a gutter support arm is connected to a centrally disposed web with two spaced apart flanges extending substantially perpendicularly from opposing edges of the central web, in the direction opposite the gutter support arm. The distance between the flanges is approximately equal to the thickness of a rafter extension and may be substantially parallel or slightly angled in order to provide a frictional fit on a rafter extension. The flanges are secured directly to the sides of the rafter extension. The central web covers a portion of the end surface of the rafter extension, providing some protection to the rafter extension. The front of the gutter support arm may lie lower than the back of the gutter support arm to inhibit the flow of water, thereby helping to preserve the dwelling's building materials. The gutter bracket need not be installed during construction, beneath the roof shingles or the like, but may be installed after construction is complete. Accordingly, it is easily removed and replaced, without the need to disturb the building's roof supports or other architecture.

8 Claims, 1 Drawing Sheet

GUTTER BRACKET

TECHNICAL FIELD

The present invention relates generally to a gutter bracket for holding a water-retaining gutter of the type conventionally found along the roof of a building, and is particularly directed to a single-piece gutter bracket which may be secured to a rafter extension rather than a soffit panel or a fascia panel of a building.

BACKGROUND OF THE INVENTION

The gutter bracket of the present invention can be applied to any roofing structure having a rafter extension. A particularly useful application is on architectural buildings having roofing structures with rafter extensions but without fascia panels or soffit panels. The gutter bracket of the present invention is a single piece assembly including a gutter support arm for holding a water-retaining gutter, two flanges acting as a bracket for attaching to both sides of a rafter extension, and a web between the flanges and centrally connected to the gutter support arm for improved symmetry, balance, and aesthetic value.

Different buildings are designed and constructed with various roofing structures. Gutter assemblies are generally attached to the exterior surfaces of the roofing structures such that rainwater flowing from the roof is directed into the gutter. While some buildings are constructed with fascia panels or soffit panels covering the rafters, many architectural building types are constructed with exposed rafters and rafter extensions. Gutter brackets designed for attaching to fascia or soffit panel roofing structures are unsuitable for use with exposed rafters due to their shape, design, and mounting assemblies. Existing brackets which are mounted on rafter extensions must be affixed either to the end of the rafter extension or to one side of the rafter extension. Obviously, end attachments and single-side attachments to a rafter extension are not as secure as attachments which are secured to both sides of a rafter extension. The brackets which are attached to the end of the rafter extension are generally screwed or nailed into the end grain of the wood, at the end of the rafter extension. Those attachments are temporary and undesirable because nails and screws pointed in the direction of the wood grain tend to fall out due to the lack of wood grain resistance. Similarly, the brackets which attach to only one side of the rafter may detach due to inadequate fastening. Moreover, the single-side fastening brackets are generally designed with the gutter support arm too close to the side of the rafter extension, fostering rotting and decay by the rainwater of the rafter extension and attached building. Other gutter brackets require attachment to the roof sheathing and therefore cannot be attached once the roof shingles are in place without having to remove the roof shingles. Analogously, the complex nature of the installation required for existing brackets pose problems when gutter systems or brackets are maintained, removed, or replaced. Further, many gutter brackets have several parts, rather than a single piece, thereby adding undue cost and complexity to the construction process.

In many applications, it is desirable to mount a gutter bracket on an exposed area which is in full open view. In those applications, it is imperative that the brackets have aesthetic value in order to be useful. However, many brackets which attach to a rafter extension have no aesthetic value and are designed to be concealed by other fixtures. The gutter bracket of the present invention obviates all of the problems associated with the use of conventional gutter brackets on rafter extensions.

An example of a gutter support arm attached to a bracket that can be mounted on a rafter extension is set forth in U.S. Pat. No. 1,478,837 to Rachlin. In that disclosure, the gutter support arm portion of the bracket does not extend from the end of the rafter extension, but rather from the side of the rafter upon which the bracket is mounted. Additionally, the bracket only attaches to one side of the rafter extension. While the Rachlin bracket may be mounted on a rafter extension, the side extension and side attachment of the bracket limit the structural integrity of the bracket attachment and the rafter extension, itself, by unnecessarily loading only one side of the rafter extension, rather than dividing the weight substantially evenly to both sides of the rafter extension.

Similarly, U.S. Pat. No. 5,303,521 to Jansen and U.S. Pat. No. 5,327,689 to Jansen disclose gutter brackets which attach to only one side of a rafter extension. Additionally, in both of those references, the brackets form and support the gutter and are part of gutter systems including fascia panels and requiring attachment of soffit panels. Furthermore, they are both designed to be installed during construction before other building components, such as roof shingles, are installed. Therefore, the gutter brackets of both Jansen references are difficult and expensive to remove or replace in the case of storm or snow damage, or during renovation or restoration, because other building components would have to be removed, as well.

Other efforts providing gutter brackets for mounting on rafter extensions include ones such as those disclosed in U.S. Pat. No. 3,874,131 to Webster, which can be selectively mounted to a side of a rafter and thus accommodate variations in both height and spacing of the rafters. However, such brackets generally require the use of an intermediate structure between the brackets and the gutter, i.e., an intermediate structure is mounted to the brackets, and the gutter thereafter mounted to the intermediate structure. Three piece assemblies of this type are thus more complex and expensive than two piece assemblies. Moreover, variations in rafter length and parallelism remain potential problems. Furthermore, this multi-piece construction is particularly designed for roofing structures including fascia panels and soffit panels.

A somewhat similar gutter assembly is set forth in U.S. Pat. No. 4,631,875 to Olson. The Olson reference describes a gutter assembly with a leaf guard and soffit strip for attachment along a roof edge. Mounting brackets are provided for installing the assembly to rafters having variations in spacing, length, height, and parallelism, and for supporting one side of a soffit strip. The gutter, including its leaf guard and connectors, is integrally constructed as is the soffit strip and its accompanying wall connector. Although the Olson reference simplifies the gutter systems with soffit panels by reducing the number of parts, it cannot be used on exposed rafter extensions without soffit panels. These brackets directly support facia panels which in turn support the gutter. Neither Webster nor Olson show direct attachment of the gutter support arm.

U.S. Pat. No. 4,258,510 to Guiana, discloses a device for attachment to roof beams (also suitable for rafter extensions) to deflect rain water running from those beams, comprising a thin, substantially L-shaped deflector attachable to the beam but opened from the beam forming a trough into which rain water runs to a drainage point. This reference discloses flanges which fit around the end and sides of a rafter extension, but it is not capable of holding a gutter.

The existing gutter brackets for installation on roofs having rafter extensions lack the improved features available for roofing structures without soffit or fascia panels. Therefore, there is a need in the art for a simple, inexpensive and aesthetically pleasing one-piece gutter bracket capable of being mounted upon both sides of a rafter extension without soffit panels or fascia panels.

SUMMARY OF THE INVENTION

It is an object of this invention to obviate the above-described problems and shortcomings of the prior art heretofore available.

It is a primary object of the present invention to provide a gutter bracket for holding a water-deflecting gutter that securely attaches to a rafter extension of a house or building.

It is another object of the present invention to provide an aesthetically pleasing single-piece gutter bracket for mounting on a rafter extension.

It is still another object of the present invention to provide a gutter bracket having two spaced apart flanges for attaching to both sides of a rafter extension, with the gutter hanger centrally aligned with the rafter extension.

It is yet another object of the present invention to provide a gutter bracket for attachment to a building without a soffit panel or a fascia panel.

It is a further object of the present invention to provide a gutter bracket that may be easily installed after all other building construction is completed, without disturbing the building's construction.

It is yet a further object of the present invention to provide a gutter bracket that may be easily removed or replaced due to storm or snow damage or for renovation, without disturbing the building's construction.

It is yet another object of the present invention to protect and extend the life of rafter extensions.

It is a further object of the present invention to provide a simple and inexpensive gutter bracket which will reduce construction and maintenance time and associated costs.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided a gutter bracket for mounting on a rafter extension with two side surfaces and an end surface. The gutter bracket includes a gutter support arm with a front end and a back end, for holding a conventional water-retaining, water-deflecting gutter. The bracket also has a central web connected to the back end of the bracket, wherein the web is configured to cover a portion of the end surface of the rafter extension. Extending from the central web are two spaced apart flanges configured for attachment to the two side surfaces of the rafter extension.

In one aspect of the invention, the front end of the gutter support arm is lower than the back end of the gutter support arm.

In another aspect of the invention, the gutter support arm, the central web, and the two spaced apart flanges preferably comprise a single piece.

In yet another aspect of the invention, the two spaced apart flanges extend substantially perpendicularly from opposite ends of the central web, in the direction opposite the gutter support arm.

In still another aspect of the invention, the two spaced apart flanges extending from opposite the ends of the central web are angled slightly inwardly, so as to frictionally engage the sides of the rafter extension.

In a further aspect of the invention, the distance between the flanges is approximately equal to the thickness of a rafter extension.

In yet a further aspect of the invention, the flanges are secured directly to both sides of the rafter extension by screws or other fasteners capable of supporting a gutter.

In still a further aspect of the invention, the gutter support arm is connected to the horizontal center of the front surface of the web.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
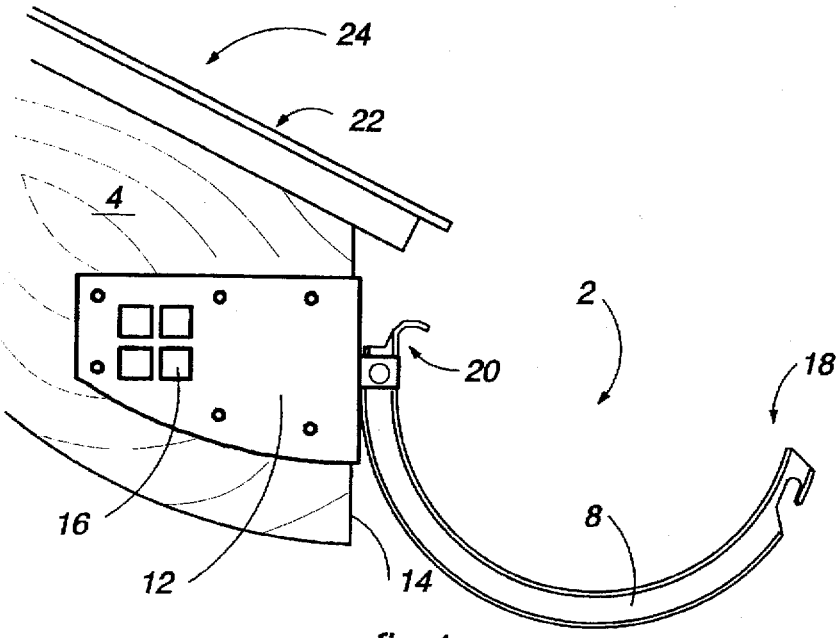
FIG. 1 is a side view of a preferred embodiment of the gutter bracket, showing the device as used on a rafter extension.

Referring now to the drawings in detail, wherein like numerals indicate the same elements throughout the views, FIG. 1 shows a preferred embodiment of a gutter bracket, generally indicated at 2, showing the device as employed for use on a rafter extension 4.

Figure 2:
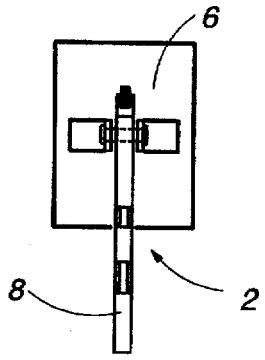
FIG. 2 is a front view of the gutter bracket, showing the web with the gutter support arm centrally attached thereon.

FIG. 2 is a front view of the gutter bracket 2, showing the centrally disposed web 6 with the gutter support arm 8 centrally connected thereon.

Figure 3:
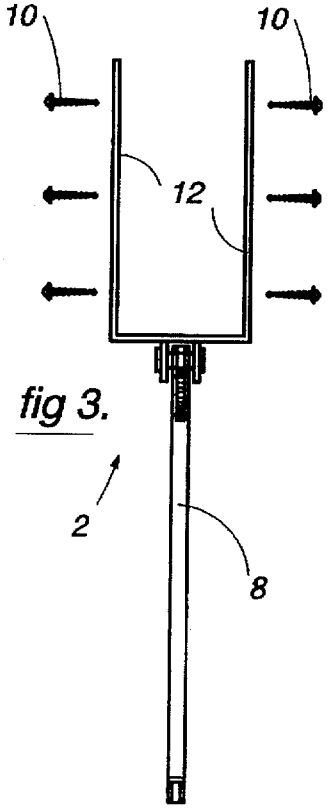
FIG. 3 is a top view of the gutter bracket, illustrating a preferred method of attaching the flanges to the sides of a rafter extension.

FIG. 3 is a top view of the gutter bracket 2, illustrating screws 10 as a preferred method of attaching the flanges 12 to the sides of a rafter extension 4.

Figure 4:
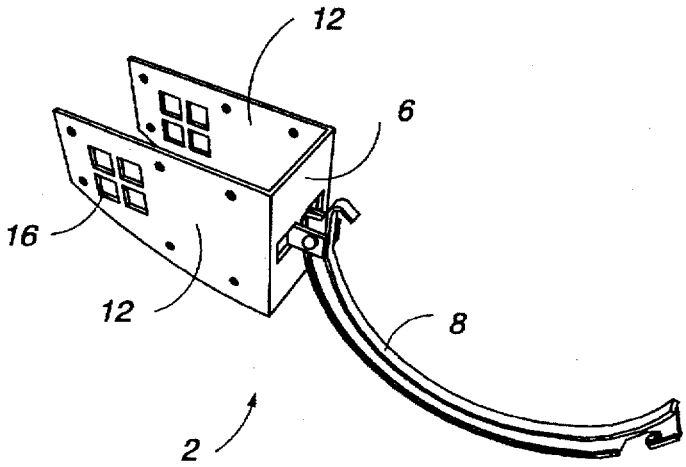
FIG. 4 is an upper perspective view of the gutter bracket, showing the rafter-grasping flanges extending from the web portion of the device.

FIG. 4 is an upper perspective view of the gutter bracket 2, showing the rafter-grasping flanges 12 extending from the web 6 portion of the device. It can be seen from FIG. 4 that a gutter support arm 8, depicted by, but not limited to, a semi-circular configuration, is connected to a centrally disposed web member 6 having two spaced apart flanges 12 extending perpendicularly from opposing edges of the central web 6, in the direction opposite the circular gutter support arm 8. The connection between the gutter support arm 8 and the web 6 may be achieved by welding, adhering, molding, screwing, bolting, or any other method of attachment suitable for supporting a gutter. The two flanges 12 and central connection of the gutter support arm 8 provide symmetry that not only enhances the gutter bracket 2 aesthetically, but also provides structural integrity not found in brackets having single-sided mountings. Evenly distributing the load to the attachments on both sides of the rafter extension 4 decreases the potential for gutter bracket 2 or rafter extension 4 destruction that is sometimes encountered with single-sided mountings, particularly in cases of snow or freezing rain. The distance between the flanges 12 is approximately equal to the thickness of a rafter extension 4. The flanges 12 may be substantially parallel or slightly angled in order to provide a frictional fit to facilitate mounting on a rafter extension 4. The flanges 12 are secured directly to the sides of the rafter extension 4 by screws 10 or other suitable fasteners, as shown in FIG. 3. The central web 6 covers a portion of the end surface 14 of the rafter extension 4, shown in FIG. 1, providing some protection and extending the life of the rafter extension 4. Ornamental designs, such as depicted at 16, may be included as part of the flanges 12 and/or central web 6, providing an aesthetic quality so that it may be left in open view. The front 18 of the gutter support arm 8 lies lower than the back 20 of the gutter support arm 8 to inhibit the flow of water against the rafter extension 4 and the accompanying dwelling (not shown), helping to preserve the dwelling's building materials.

The gutter bracket 2 need not be installed during construction of the building, beneath the roof shingles 22 or the like, but may be installed after construction is complete. Accordingly, it is also easily removed and replaced, without the need to disturb the building's roof 24, supports (not shown), or other architecture.

In summary, numerous benefits have been described which result form employing the concepts of the invention. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A gutter bracket for mounting on a rafter extension with two side surfaces and an end surface, comprising:

a gutter support arm having a front end and a back end;

a central web connected to said back end, said web configured to cover a portion of the end surface of the rafter extension; and two spaced apart flanges extending from said central web, said flanges configured for respective attachment to the two side surfaces of the rafter extension.

2. The gutter bracket of claim 1, wherein the front end of said gutter support arm is disposed lower than the back end of said gutter support arm.

3. The gutter bracket of claim 1, wherein the gutter support arm, the central web, and the two spaced apart flanges comprise a single piece.

4. The gutter bracket of claim 1, wherein the central web has opposite ends, and wherein the two spaced apart flanges extend substantially perpendicularly from the opposite ends of the central web, in the direction opposite the gutter support arm.

5. The gutter bracket of claim 1, wherein the central web has opposite ends, and wherein the two spaced apart flanges extend from the opposite the ends of the central web, angled inwardly, so as to frictionally engage the sides of the rafter extension.

6. The gutter bracket of claim 1, wherein the distance between the flanges is approximately equal to the thickness of a rafter extension.

7. The gutter bracket of claim 1, wherein the flanges are secured directly to the sides of the rafter extension by screws or other fasteners capable of supporting a gutter.

8. The gutter bracket of claim 1, wherein the web has a front surface, and further wherein the gutter support arm is connected to the horizontal center of the front surface of the web.

* * * * *